US008597468B2

(12) United States Patent
Ryan et al.

(10) Patent No.: US 8,597,468 B2
(45) Date of Patent: Dec. 3, 2013

(54) JOINING PROCESS FOR A PAPERMACHINE CLOTHING

(75) Inventors: Matthew Ryan, Appleton, WI (US); Susanne Klaschka, Nuremberg (DE)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 13/311,187

(22) Filed: Dec. 5, 2011

(65) Prior Publication Data

US 2013/0139989 A1 Jun. 6, 2013

(51) Int. Cl.
*D21F 7/08* (2006.01)
*D21F 7/10* (2006.01)
*D06H 5/00* (2006.01)

(52) U.S. Cl.
USPC ... 162/358.2; 162/900; 162/904; 139/383 AA

(58) Field of Classification Search
USPC ..... 162/348, 358.2, 900, 902–904; 139/383 A, 383 AA, 425 A; 428/57, 58, 428/60
See application file for complete search history.

(56) References Cited

U.S. PATENT DOCUMENTS 926,004 A * 6/1909 Keller ..... 139/383 R
3,238,594 A * 3/1966 Schuster ..... 28/141
3,622,415 A * 11/1971 Kunsman ..... 156/158
3,700,194 A * 10/1972 MacBean ..... 245/10
4,311,172 A * 1/1982 Eckstein ..... 139/383 AA
4,771,814 A * 9/1988 Quigley ..... 139/383 AA
5,366,778 A * 11/1994 Johnson ..... 428/58
5,713,399 A * 2/1998 Collette et al. ..... 139/383 AA
7,005,038 B2 * 2/2006 Maguire ..... 162/348
7,381,307 B2 * 6/2008 Silakoski ..... 162/358.2
7,513,277 B2 * 4/2009 Crook et al. ..... 139/383 AA
7,527,707 B2 * 5/2009 Davenport et al. ..... 162/358.2
7,918,970 B2 * 4/2011 Bez ..... 162/358.2

FOREIGN PATENT DOCUMENTS

DE 901256 * 1/1954
WO WO 2004055265 A1 4/2004

* cited by examiner

*Primary Examiner* — Eric Hug
(74) *Attorney, Agent, or Firm* — Taylor IP, P.C.

(57) ABSTRACT

A joining process for an endless or seamed press fabric, the joining process including the step of providing a woven base fabric having a plurality of monofilament yarns including warp yarns extending in a machine direction and weft yarns extending in a cross machine direction, the woven base fabric being cut along one of the weft yarns and having two opposing ends and two side edges. A predetermined number of the weft yarns are removed along each of the two opposing ends to free a plurality of cut ends of the warp yarns, fringing the ends. The plurality of free cut ends of the two opposing ends are interdigitated with each other and the cut ends opposing and adjoining one another are heat bonded to define a joint area.

23 Claims, 4 Drawing Sheets

JOINING PROCESS FOR A PAPERMACHINE CLOTHING

BACKGROUND OF THE INVENTION

1. Field of the Invention

The present invention relates to paper machine clothing and a process for joining a paper machine clothing, and more particularly, to joining processes used to join ends of a paper machine clothing in an endless manner.

2. Description of the Related Art

A paper machine clothing (PMC) base fabric, such as for a press fabric or a forming fabric, is typically manufactured with a specific set of design and quality specifications for a particular paper machine's performance requirements. These specifications include specific dimensions, surface characteristics, open area, void volume, permeability and smoothness, among others.

The purpose of a press fabric in a paper making machine is to transport water away from the fibrous material web. The press fabric travels with the fibrous web through a press section of the paper machine where pressure is applied to the fibrous material web and press fabric traveling therewith in order to remove as much liquid or water as possible from the web. Accordingly, it is important to provide a fabric having a substantially uniform surface structure in order to avoid marking of the fibrous web from pressing.

It is known in the art to manufacture a woven press fabric having a flat woven base fabric with a plurality of warp yarns forming seam loops along the ends of the fabric extending in a cross machine direction, transverse to the machine direction. The ends are then placed in end-to-end disposition in order to interdigitate the loops and a pintle wire is then inserted in the interdigitated loops to lock the ends together to bring the fabric into an endless form. For installation in a paper machine of the like, the two ends are separated such that the fabric can be pulled in its direction of movement into the machine, after which the two belt longitudinal ends can then be joined together again. The region of the seam in this case has a larger void area than the rest of the fabric, resulting in a differential dewatering in this area which may lead to marking of the fibrous web. In addition, the formation of seam loops on the base fabric results in increased production time and expense.

Further, it is known from international publication EP 1 579 066 to manufacture a press felt from a base fabric including a plurality of machine direction (MD, warp) yarns and cross machine direction (CD, weft) yarns. To form the press fabric, the two ends of the planar fabric are then overlapped and heat is applied to melt bond the threads. During the application of heat, the joining ends areas of the base fabric may be pressed so that the thickness of the overlapping joining ends areas substantially corresponds to the thickness of the rest of the fabric. It is further known from EP 1 579 066 to manufacture the base fabric with a thinned portion, where the density of transverse yarns is smaller on the ends than the rest of the base fabric, so that the thickness of the overlapping joint is decreased.

What is needed in the art is an improved joining process for a paper machine clothing base fabric which improves the life expectancy of the fabric while reducing the risk of sheet marking by providing a substantially uniform air permeability, caliper, mass and density.

SUMMARY OF THE INVENTION

The present invention provides a joining process for use in an endless or seamed press fabric or felt including the step of providing a woven base fabric having a plurality of monofilament yarns including warp yarns extending in a machine direction and weft yarns extending in a cross machine direction. The woven base fabric is cut along one of the weft yarns and has two opposing ends and two side edges. A predetermined number of weft yarns are removed along each of the two opposing ends to free a plurality of cut ends of the warp yarns, effectively fringing the ends. The free cut ends of the two opposing ends are then interdigitated with each other. The cut ends opposing and adjoining one another are then temporarily heated bonded or chemically bonded to define a joint area. Interdigitating in accordance with the present invention means to interlock like the fingers of folded hands.

The present invention further provides a joining process for a PMC base fabric, such as for a press fabric or a forming fabric, including the step of providing a woven base fabric having a plurality of yarns including warp yarns extending in a machine direction and weft yarns extending in a cross machine direction. The woven base fabric has two opposing step-shaped ends made by a plurality of cuts offset in the machine direction. A predetermined number of the weft yarns are removed along each of the two opposing step-shaped ends to free a plurality of cut ends of the warp yarns. The cut ends of the two opposing ends are then interdigitated with each other and the cut ends opposing and adjoining one another are temporarily heat bonded or chemically bonded at a cross point to define a joint area.

The present invention further provides a joining process for a PMC base fabric, for example for a press fabric or a forming fabric, including the step of providing a woven base fabric having a plurality of monofilament yarns including warp yarns extending in a machine direction and weft yarns extending in a cross machine direction. The woven base fabric has two opposing step-shaped ends made by a plurality of cuts offset in the machine direction. A predetermined number of the weft yarns are removed along each of the two opposing step-shaped ends to free a plurality of cut ends of the warp yarns, effectively fringing the ends. The cut ends of the two opposing ends are then interdigitiated with each other and, subsequently, the cut ends opposing and adjoining one another are temporarily heat bonded or chemically bonded at a cross point to define a joint area.

The present invention also provides a press fabric formed by a woven base fabric including warp yarns extending in a machine direction and weft yarns extending in a cross machine direction and having two opposing ends cut along a weft yarn. A joint area of the press fabric is defined by cut ends of the warp yarns which have been freed by removing a predetermined number of weft yarns along each of the two opposing ends. The cut ends of the two opposing ends are interdigitated with each other and temporarily heat bonded or chemically bonded to form the endless press fabric.

Another advantage of the present invention is that the removal of a predetermined number of weft yarns from along the cut ends of the base fabric reduces the number of threads in the joint area, thereby advantageously reducing the thread density of the joint area such that the void volume and permeability are increased.

Yet another advantage of the joining process of the present invention is that the join only holds the fabric together during internal processing and then subsequently breaks up in a manner that avoids sheet marking of a fibrous material web which is being produced on the papermaking machine. In contrast, joining processes known in the art result in a hard welded area that can cause sheet marks as the felt wears down from running on the papermaking machine.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 1:
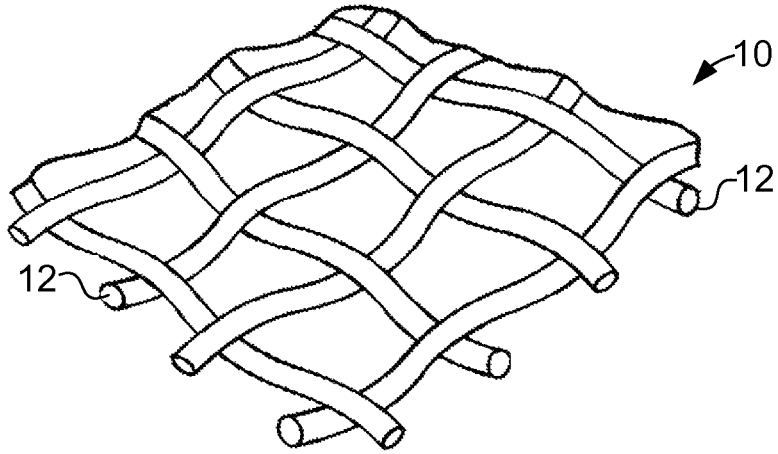
FIG. 1 is a fragmentary, perspective view of a portion of a woven base fabric in accordance with the present invention.
Figure 2:
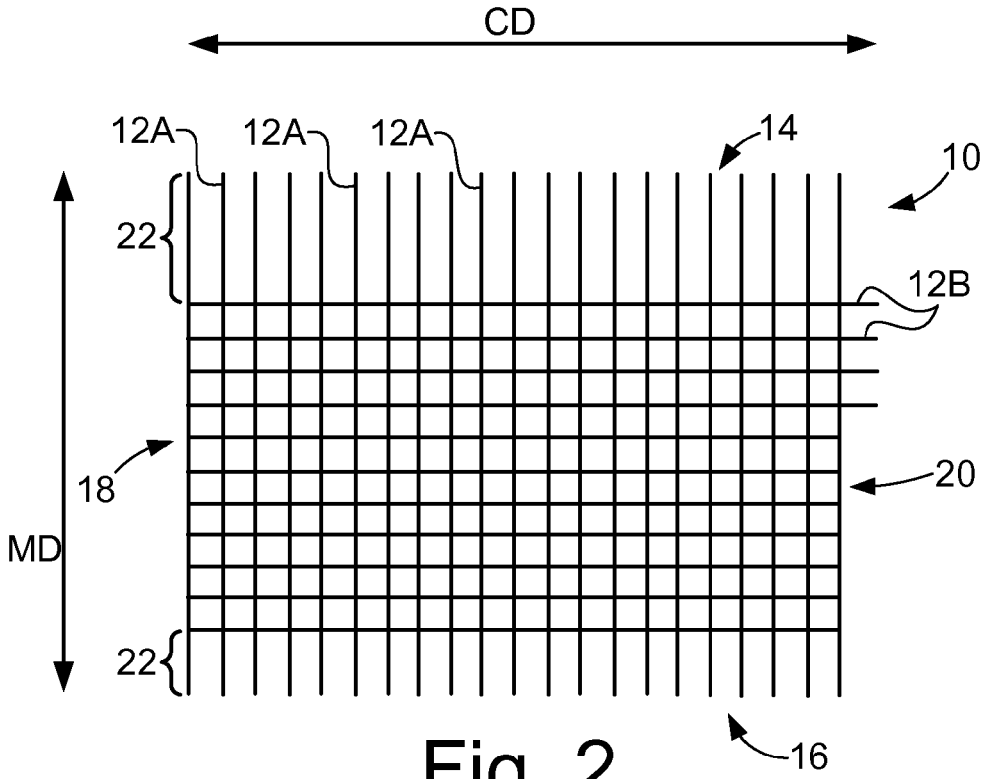
FIG. 2 is a schematic view of the woven base fabric of FIG. 1 having fringed end portions in accordance with the present invention.

Referring now to the drawings, and more particularly to FIGS. 1 and 2, there is shown a portion of woven base fabric 10 which generally includes a plurality of monofilament yarns 12, which may have a yarn diameter, for example, in a range between approximately 56 decitex (dtex) and 3200 dtex. As illustrated in FIG. 2, monofilament yarns 12 of woven base fabric 10 are further defined as being warp yarns 12A, which extend in machine direction MD, and weft yarns 12B, which extend in cross machine direction CD. According to a first embodiment of the joining process of a press fabric according to the present invention, woven base fabric 10 has an end which is cut along one of weft yarns 12B and has two opposing ends 14, 16 and two side edges 18, 20. A predetermined number of weft yarns 12B extending along each of opposing ends 14, 16, for example between 1 and 7 weft yarns 12B, are removed to free a plurality of cut ends 22 of warp yarns 12A. Cut ends 22 of end 14 are then interdigitated with cut ends 22 of opposing end 16 and temporarily heat bonded or chemically bonded to define a joint area and form an endless press fabric. Press fabric 12 has, for example, a yarn density in a range between approximately 6 yarns per square centimeter (yarns/$cm^2$) and 260 yarns/$cm^2$.

Figure 4:
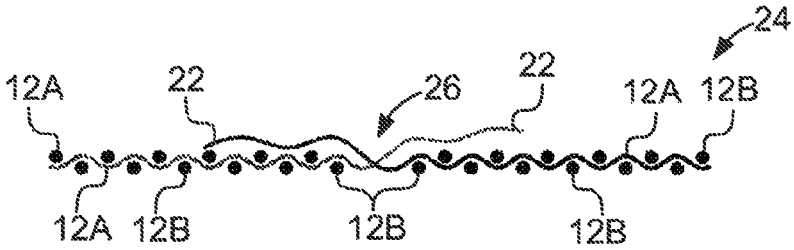
FIG. 4 is a side view of a press fabric joint according to an embodiment of the present invention.
Figure 5:
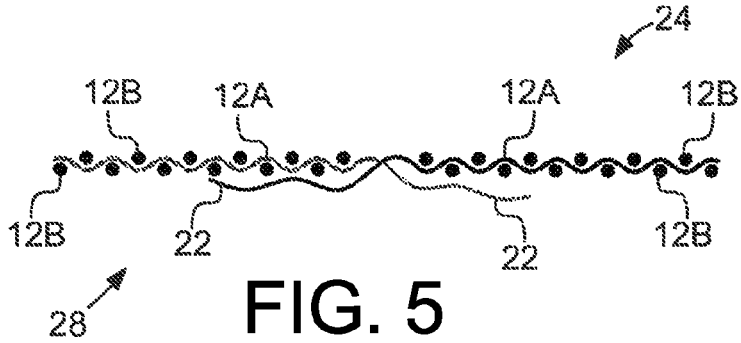
FIG. 5 is a side view of a press fabric joint according to an embodiment of the present invention.
Figure 6:
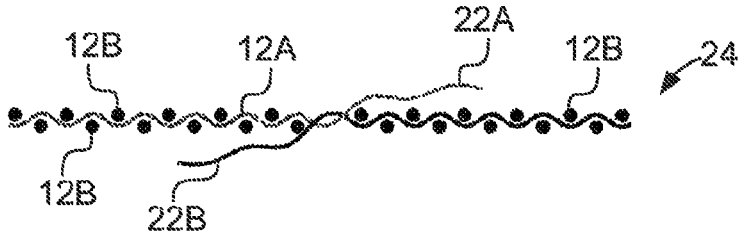
FIG. 6 is a side view of a press fabric joint according to an embodiment of the present invention.
Figure 7:
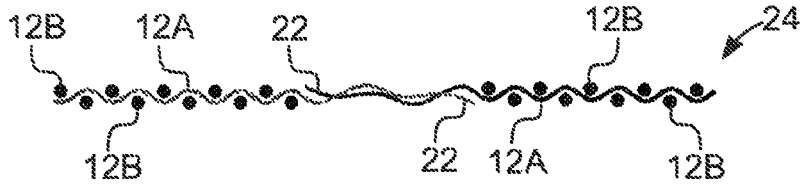
FIG. 7 is a schematic view of a woven base fabric having fringed step-shaped end portions in accordance with the present invention.

According to the present invention, cut ends 22 of opposing ends 14, 16 may be in a number of positions across the joint area of endless press fabric 24, illustrated in FIG. 4. In FIG. 4, it is shown that cut ends 22 of opposing ends may all be positioned on paper side 26 of woven base fabric 10. Alternatively, cut ends 22 of opposing ends 14, 16 may all be positioned on machine side 28 of woven base fabric 10, as illustrated in FIG. 5. According to another embodiment of the present invention illustrated in FIG. 6, cut ends 22A of end 14 may be positioned on paper side 26 of woven base fabric 10 and cut ends 22B may be positioned on machine side 28 of woven base fabric 10. In each of the embodiments of the present invention illustrated in FIGS. 4-6, the cut ends overlap with at least one weft yarn 12B. Referring now to FIG. 7, according to an alternative embodiment of the present invention, cut ends 22 and 22 do not overlap with any weft yarns 12B.

According to the present invention, the heat bonding step of the joining process may be by ultrasonic welding, radiofrequency welding, a hot iron, induction heating, a hot wedge, a hot knife, a hot wire, a hot weld and/or ironing. The heat bonding may, for example, be ultrasonic welding on the paper side surface of the woven base fabric. The heat bonding is conducted at a heat distortion temperature sufficient to soften the monofilament yarns of the woven base fabric and securely bond the filaments in the joint area without substantially altering the structure of the yarn. As a result, the permeability of the joint area is substantially the same as the rest of the produced endless press fabric outside of the joint area. Advantageously, this reduces the risk of marking the fibrous material web being produced, as well as maintaining substantially the same void volume as the rest of the fabric outside of the joint area.

According to one embodiment of the joining process of the present invention, all of cut ends 22 are heat bonded to adjoining monofilament threads 12. Alternatively, it is also feasible if less than all of cut ends 22 are temporarily heat bonded or chemically bonded to adjoining monofilament threads 12.

The joining process according to the present invention may further include the step of adding supplemental material in the form of resin, ribbon, yarn, thread and/or foam to the joint area of the endless press fabric. The supplemental material may be interwoven with free cut ends 22, positioned on the machine side of the joint area and/or positioned on the paper side of the joint area.

The joint area of the press fabric according to the present invention has a caliper of, for example, between approximately 80% and 98% of the remaining portion of the woven base fabric outside of the joint area. Alternatively, the joint area may have a caliper between approximately 102% and 135% of the remaining portion of the woven base fabric outside of the joint area. The defined caliper of the joint area according to the present invention allows for an air permeability consistent with that of the remaining portion of the woven base fabric outside of the joint area, which further prevents marking of a fibrous material web which is being produced on the papermaking machine.

Figure 3:
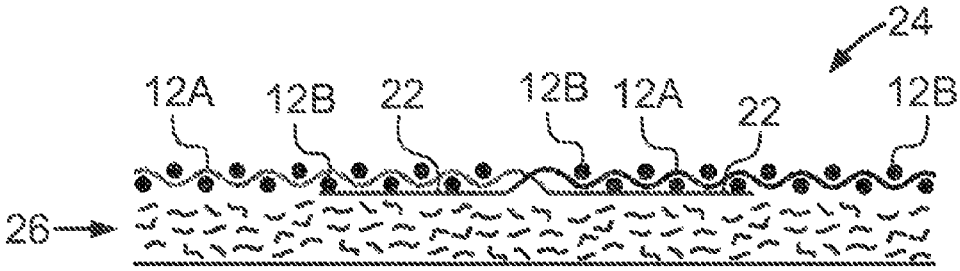
FIG. 3 is a side view of a press fabric joint according to an embodiment of the present invention.

Referring now to FIG. 3, there is shown an embodiment of the press fabric of the present invention which includes at least one non-woven fibrous batt layer 26. The at least one batt layer may be placed, for example, on top of (the paper side) woven base fabric 10 or on the bottom of (the machine side) woven base fabric 10 to form press fabric 24.

Figure 8:
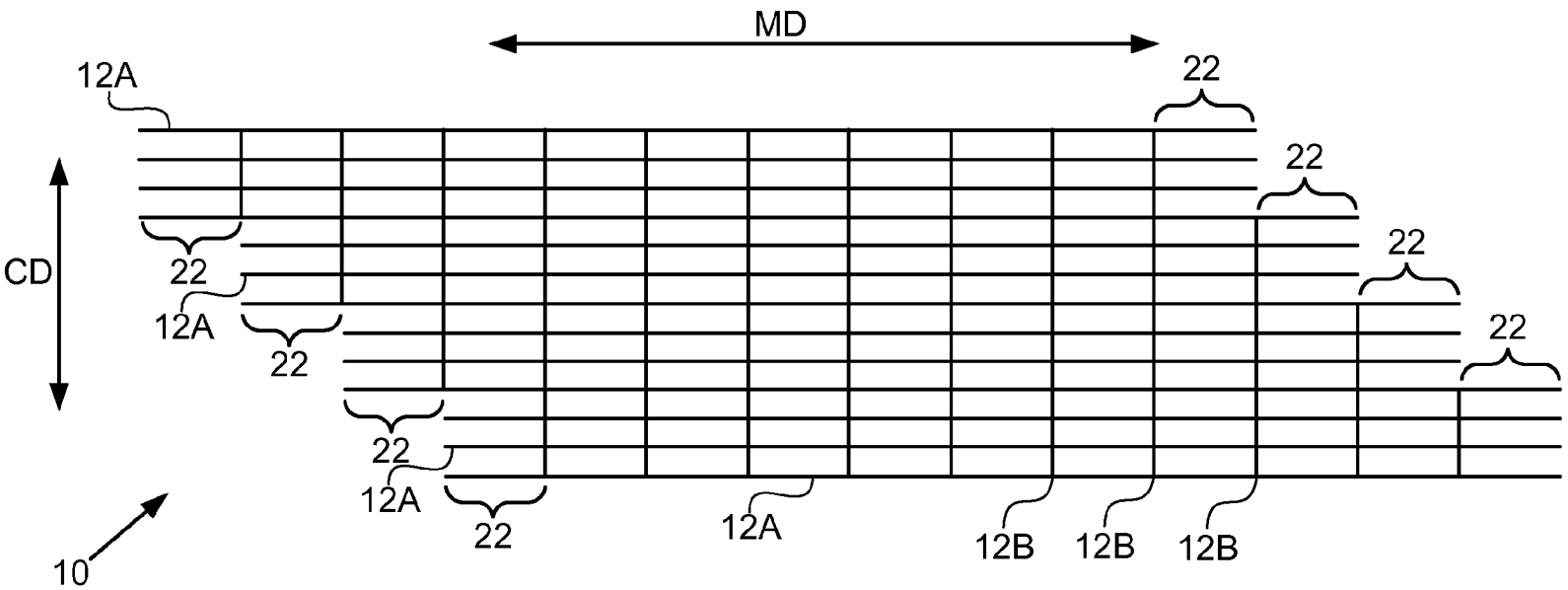
FIG. 8 is a side view of an endless press fabric according to the present invention.

Referring now to FIG. 8, according to another embodiment of the present invention, woven base fabric 10 has two opposing ends 14, 16 which are step-shaped made by a plurality of cuts offset in the machine direction of woven base fabric 10. A predetermined number of weft yarns 12B are removed from each of opposing ends 14, 16, thereby effectively fringing the base fabric and freeing cut ends 22 which are then interdigitated with cut ends of the opposing end and temporarily heat bonded or chemically bonded to one another to form a secure, air permeable joint. It is feasible to remove the same number of weft yarns 12B, for example 1-7 yarns, along the entirety of the respective end(s) 14, 16. It is also feasible to remove a different number of weft yarns along the various steps of the step-shaped end.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A joining process for an endless press or seamed fabric, the joining process comprising the steps of:

providing a woven base fabric having a plurality of yarns including warp yarns extending in a machine direction and weft yarns extending in a cross machine direction, said woven base fabric being cut along one of said weft yarns and having two opposing ends and two side edges;

removing a predetermined number of said weft yarns along each of said two opposing ends to free a plurality of cut ends of said warp yarns;

interdigitating said plurality of free cut ends of said two opposing ends with each other; and temporarily one of heat bonding and chemical bonding said plurality of cut ends opposing and adjoining one another to define a joint area, wherein said joint area has a caliper between approximately 80 and 98% of a remaining portion of said woven base fabric outside of said joint area.

2. The joining process according to claim 1, further comprising the step of positioning said opposing free cut ends on one of a machine side surface and a paper side surface of said woven base fabric before said step of one of heat bonding and chemically bonding.

3. The joining process according to claim 1, further comprising the step of positioning a first set of said free cut ends extending from one of said two opposing ends on said paper side surface and a second set of said free cut ends extending from another of said two opposing ends on said machine side surface.

4. The joining process according to claim 1, wherein said interdigitated plurality of free cut ends overlap with at least one of said weft yarns of said woven base fabric.

5. The joining process according to claim 1, wherein said interdigitated plurality of free cut ends do not overlap with any of said weft yarns of said woven base fabric.

6. The joining process according to claim 1, wherein said heat bonding step is by one of ultrasonic welding, laser welding, radio frequency (RF) welding, a hot iron, induction heating, a hot wedge, a hot knife, a hot wire, a hot weld and an iron.

7. The joining process according to claim 1, wherein said heat bonding step includes applying heat to said joint area, said heat being at a heat distortion temperature sufficient to soften said plurality of yarns and temporarily securely bond said yarns in said joint area.

8. The joining process according to claim 1, wherein the press fabric has a yarn density in a range between approximately 6 yarns/$cm^2$ and 260 yarns/$cm^2$.

9. The joining process according to claim 8, wherein said plurality of yarns have a yarn diameter in a range between approximately 56 decitex (dtex) and 3200 dtex.

10. The joining process according to claim 9, wherein between 1 and 7 of said weft yarns are removed along at least one of said two opposing ends.

11. The joining process according to claim 10, wherein said heat bonding is by ultrasonic welding on said paper side surface of said woven base fabric.

12. The joining process according to claim 1, further comprising the step of adding a supplemental material to said joint area, said supplemental material being at least one of a resin, ribbon, yarn, thread, a chemical treatment and a foam.

13. The joining process according to claim 12, wherein said supplemental material is one of interwoven with said free cut ends, positioned on a machine side of said joint area and positioned on a paper side of said joint area.

14. The joining process according to claim 1, further comprising the step of adding at least one fibrous non-woven batt layer on top of said woven base fabric.

15. A joining process for a paper machine clothing (PMC) base fabric, the joining process comprising the steps of:

providing a woven base fabric having a plurality of monofilament yarns including warp yarns extending in a machine direction and weft yarns extending in a cross machine direction, said woven base fabric having two opposing step-shaped ends with a plurality of cuts offset in said machine direction;

removing a predetermined number of said weft yarns along each of said two opposing step-shaped ends to free a plurality of cut ends of said warp yarns;

interdigitating said plurality of free cut ends of said two opposing ends with each other; and heat bonding said plurality of cut ends opposing and adjoining one another at a cross point to define a joint area, wherein said joint area has a caliper between approximately 80 and 98% of a remaining portion of said woven base fabric outside of said joint area.

16. The joining process according to claim 15, further comprising the step of bonding at least one fibrous non-woven batt layer with said woven base fabric, said at least one batt layer being positioned on a paper side of said woven base fabric.

17. A press fabric, comprising:

a woven base fabric having a plurality of monofilament yarns including warp yarns extending in a machine direction and weft yarns extending in a cross machine direction, said woven base fabric cut along one of said weft yarns defining two opposing ends and a predetermined number of said weft yarns of each of said two opposing ends removed to free a plurality of cut ends of said warp yarns, said plurality of cut ends of said two opposing ends being interdigitated ends with each other and heat bonded with each other such that said plurality of cut ends opposing and adjoining one another define a joint area, wherein said joint area has a caliper between approximately 80 and 98% of a remaining portion of said woven base fabric outside of said joint area.

18. The press fabric according to claim 17, wherein said two opposing ends include a first end and a second end, said first end including a first set of said plurality of cut ends and said second end including a second set of said plurality of cut ends, said first set and said second set of said cut ends being positioned on at least one of a machine side and a paper side of said woven fabric.

19. The press fabric according to claim 18, wherein said first set of cut ends is positioned on said machine side of said woven fabric and said second set of cut ends is positioned on said paper side of said woven fabric.

20. The press fabric according to claim 17, wherein said interdigitated plurality of free cut ends overlap with at least one of said weft yarns of said woven base fabric.

21. The press fabric according to claim 17, further comprising supplemental material in said joint area, said supplemental material being at least one of a resin, ribbon, yarn, thread, a chemical treatment and a foam.

22. The press fabric according to claim 21, wherein said supplemental material is one of interwoven with said free cut ends, positioned on said machine side of said joint area and positioned on said paper side of said joint area.

23. A joining process for an endless press or seamed fabric, the joining process comprising the steps of:

providing a woven base fabric having a plurality of yarns including warp yarns extending in a machine direction and weft yarns extending in a cross machine direction, said woven base fabric being cut along one of said weft yarns and having two opposing ends and two side edges;

removing a predetermined number of said weft yarns along each of said two opposing ends to free a plurality of cut ends of said warp yarns;

interdigitating said plurality of free cut ends of said two opposing ends with each other; and temporarily one of heat bonding and chemical bonding said plurality of cut ends opposing and adjoining one another to define a joint area, wherein said joint area has a caliper between approximately 102 and 135% of a remaining portion of said woven base fabric outside of said joint area.

* * * * *

UNITED STATES PATENT AND TRADEMARK OFFICE

CERTIFICATE OF CORRECTION

PATENT NO. : 8,597,468 B2
APPLICATION NO. : 13/311187
DATED : December 3, 2013
INVENTOR(S) : Matthew Ryan et al.

It is certified that error appears in the above-identified patent and that said Letters Patent is hereby corrected as shown below:

On The Title Page, item (75) Inventors, please delete "Nuremberg", and substitute therefore --Nuernberg--.

Signed and Sealed this
Third Day of February, 2015

Michelle K. Lee

Michelle K. Lee
*Deputy Director of the United States Patent and Trademark Office*